US005423280A

United States Patent [19]

Kelley

[11] Patent Number: 5,423,280

[45] Date of Patent: Jun. 13, 1995

[54] SEAT HINGE

[76] Inventor: Michael A. Kelley, P.O. Box 188, Azle, Tex. 76020

[21] Appl. No.: 157,687

[22] Filed: Nov. 24, 1993

[51] Int. Cl.[6] ..... B63B 17/00

[52] U.S. Cl. ..... 114/363; 297/313

[58] Field of Search ..... 114/361, 362, 363, 364; 297/311, 313

[56] References Cited

U.S. PATENT DOCUMENTS

| | | | |
|---|---|---|---|
| 1,059,220 | 4/1913 | Saxon | 297/313 |
| 4,462,634 | 7/1984 | Hanagan | 297/311 |
| 4,792,185 | 12/1988 | Oshikawa | 297/311 |
| 5,116,100 | 5/1992 | Iversen | 297/313 |

*Primary Examiner*—Stephen P. Avila
*Attorney, Agent, or Firm*—Arthur F. Zobal

[57] ABSTRACT

The seat hinge is formed of a base plate hinged to a seat plate which is hinged to a support member. The bottom of the base plate is adapted to be connected to a base member and the top of the seat plate is adapted to be connected to a seat. The seat plate can be pivoted close to the base plate with the support member located therebetween to locate the seat in a down position and to an inclined position, supported by the support member, to locate the seat in an inclined position.

4 Claims, 4 Drawing Sheets

SEAT HINGE

BACKGROUND OF THE INVENTION

1. Field of the Invention

The invention relates to an apparatus for supporting a seat to a base member which is particularly useful on boats used for fishing purposes.

2. Description of the Prior Art

Seats on pedestals on fishing boats have been used for many years.

Summary of the Invention

It is an object of the invention to provide a new and useful apparatus for supporting a seat to a base member and which allows the seat to be adjusted to different positions.

The apparatus comprises a base plate hinged to a seat plate which is hinged to a support member. The bottom of the base plate is adapted to be connected to a base member and the top of the seat plate is adapted to be connected to a seat. The seat plate can be pivoted close to the base plate with the support member located therebetween to locate the seat in one position and to an inclined position, supported by the support member, to locate the seat in an inclined position.

DESCRIPTION OF THE PREFERRED EMBODIMENT

Figure 1:
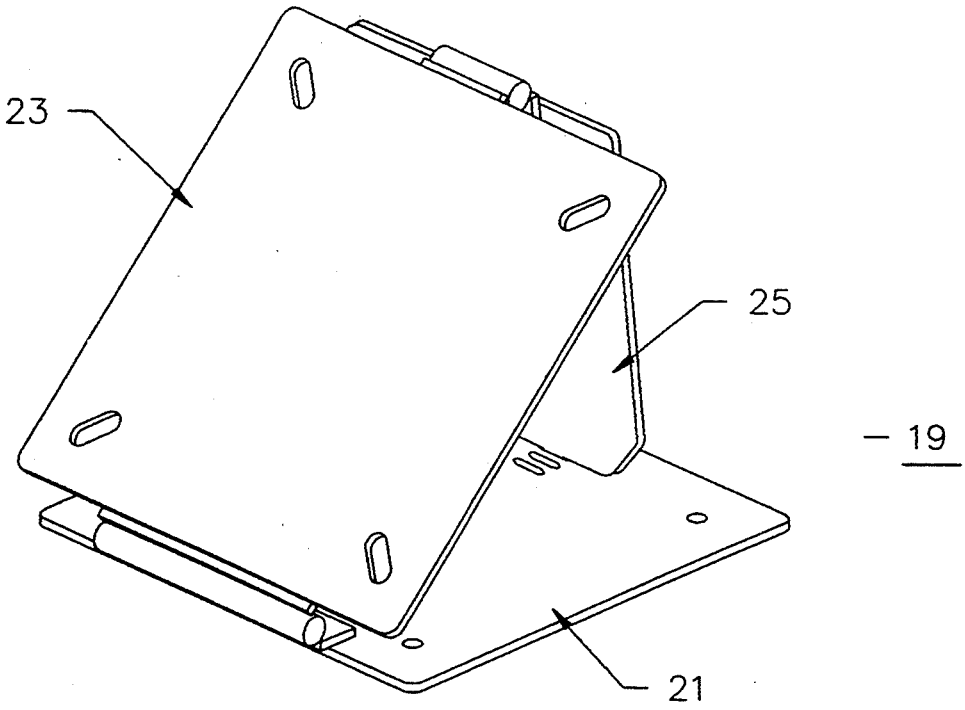
FIG. 1 is a perceptive view of the apparatus of the invention with the seat plate located in an inclined position.

Referring to the drawings, the apparatus of the invention is identified by reference numeral 19. The apparatus comprises a flat metal base plate 21, a flat metal seat plate 23 and a flat metal support member 25. The base plate 21 has a first end 21F, a second end 21S, a top side 21T and a bottom side 21B. The base plate 23 has a first end 23F, a second end 23S, a top side 23T and a bottom side 23B. The support member 25 has a first end 25F, a second end 25S, an outer side 25(O) and an inner side 25(I). A first hinge 31 is connected to the top side 21T of the base plate 21 at its second end 21S and to the bottom side 23B of the seat plate at its first end 21F. A second hinge 41 is connected to the bottom side 23B of the base plate 23 at its second end 23S and to the inner side 25(I) of the support member at its first end 25F.

The base plate 21 has three elongated apertures 51A, 51AB, and 53C formed therethrough near its first end 21F. A tab 25T1 extends from the end 25S of the support member 25 and a tab 25T2 extends from the outer side 25(O) of the support member 25. Tab 25T1 has an aperture 61 extending therethrough and tab 25T2 has an aperture 62 extending therethrough.

Four threaded apertures 71 extend through the base plate 21 for receiving bolts 73 for attaching the bottom side 21B of plate 21 to side flanges 75F on each side of a base member 75 of a conventional pedestal 77 which may be attached to a boat. The base member 75 may be rotatable relative to pedestal 77. The flanges 75F have apertures 75A for receiving the shafts of the bolts 73. The base 75 has front and rear side plates 75FP and 75RP that extend beyond the front and rear edges 75FE and 75RE for supporting front and rear portions of side the flanges 75F. The side flanges 75 do not extend across the front and rear ends of the base 75 leaving openings 76 between the side flanges 75 at the front and rear portions of the base 75 for receiving the tab 25T1 depending on which direction the apparatus of the invention is secured to the base 75.

Four elongated apertures 81 extend through the seat plate 23 for receiving bolts 84 allowing the top side of the seat plate 23 to be secured to the bottom of a seat 85.

The seat plate 23 may be located at an acute angle theta relative to the base plate 21 with the support member 25 located at an acute angle alpha relative to the seat plate 23 to allow the tab 25T1 to be located in either of apertures 51A, 51B, or 51C to support the seat 2. A pin (not shown) may be inserted through the aperture 61 of the tab 25T1 to removably lock the tab 25T1 in the selected aperture 51A, 51B, or 51C. In the inclined position of the seat 85 the user will in effect lean against the seat 85.

Figure 4:
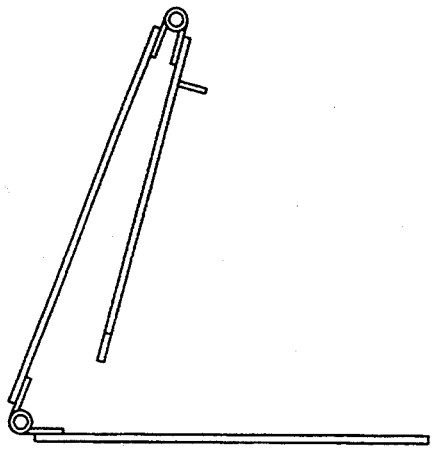
FIG. 4 is a side view of the apparatus of FIG. 1 in a partial folded position for positioning the seat plate from the inclined position of FIG. 1 to the down position of FIG. 3.
Figure 8:
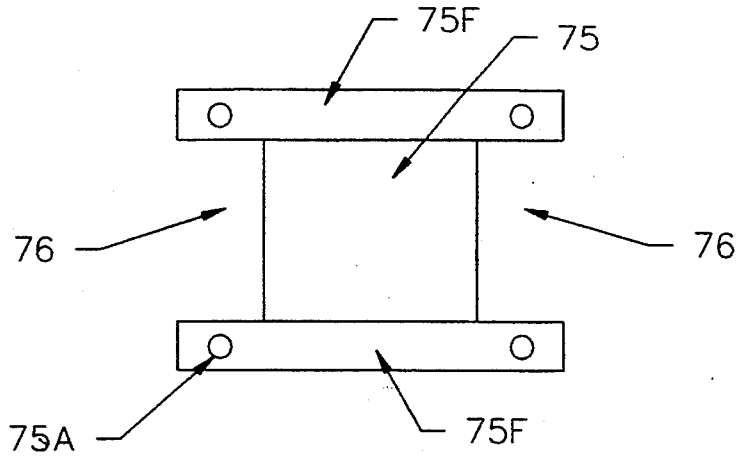
FIG. 8 is a top plan view of a base member to which the apparatus of the invention may be connected.
Figure 2:
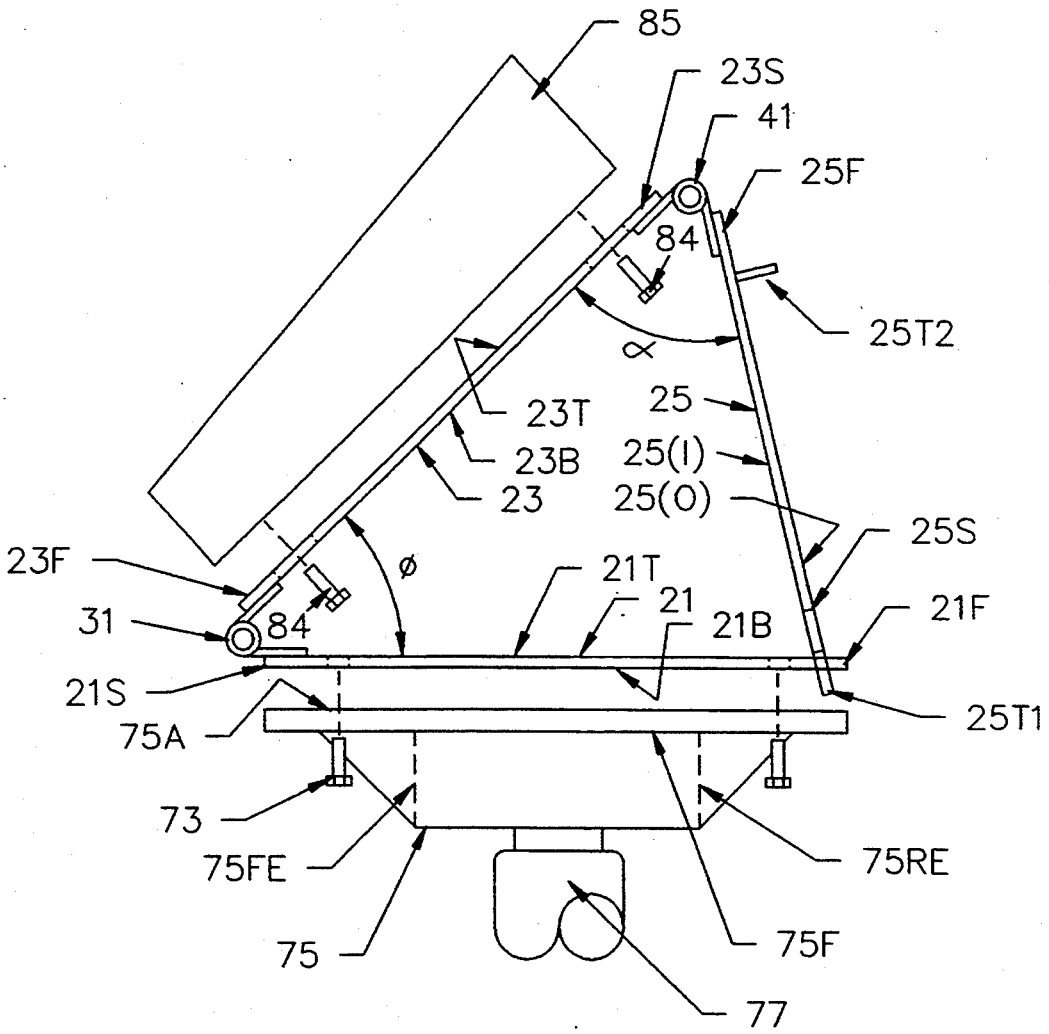
FIG. 2 is a side view of the apparatus of FIG. 1 with a seat and a base member shown in exploded positions from the apparatus.
Figure 6:
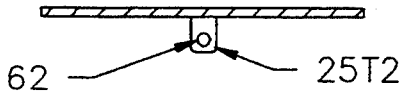
FIG. 6 is a cross section of FIG. 5 taken along lines 6—6 thereof.
Figure 3:
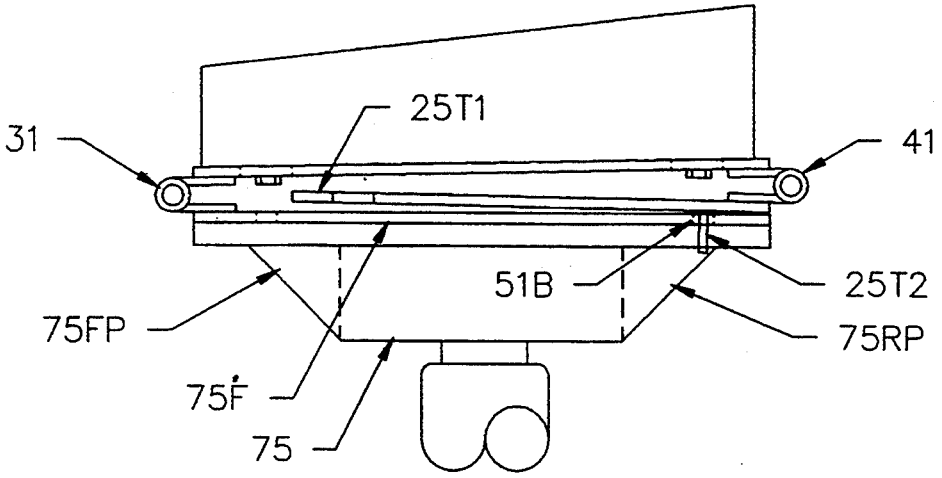
FIG. 3 is a side view of the apparatus of FIG. 1 with the seat plate located in a down position and a seat and base member connected to the seat plate and base plate respectively.
Figure 7:
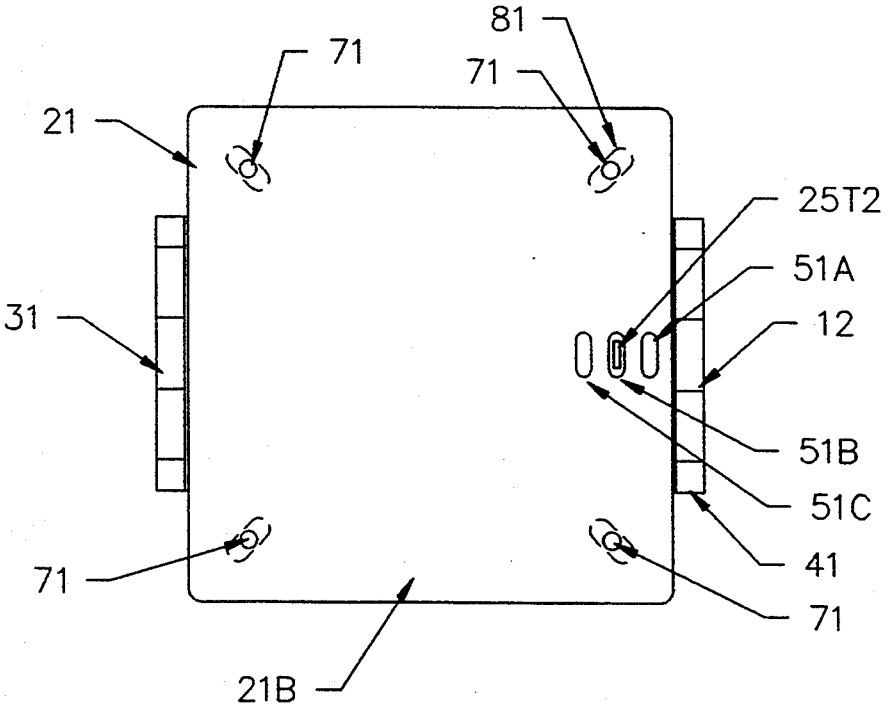
FIG. 7 is a plan view of the apparatus of the invention folded in the position shown in FIG. 3 as seen from the bottom side of the base plate.
Figure 5:
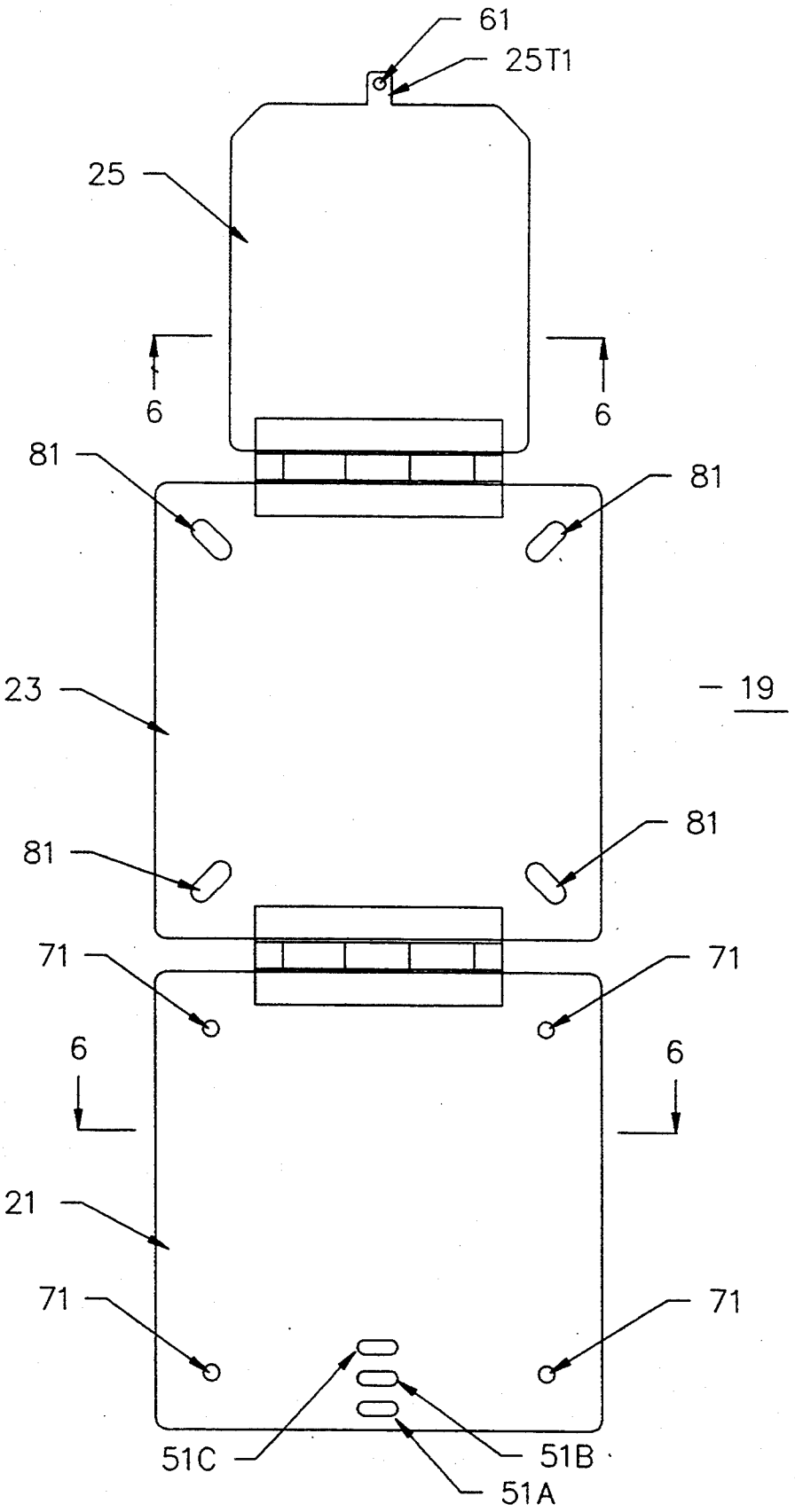
FIG. 5 is a plan view of the apparatus of FIG. 1 with all three members in a flat extended position.

For setting on the seat 85, the tab 25T1 may be removed from the selected aperture 51A, 51B, and 51C and the member 25 folded against the bottom side of the seat plate 23 as shown in FIG. 4 and both the seat plate 23 and support member 25 folded next to the top side 21T of the base plate 21 as shown in FIG. 3. In this position, the tab 25T2 extends through the aperture 51B and apertures 71 are in alignment with the apertures 81 as shown in FIG. 7. A pin may be inserted through the aperture 25T2 to removably lock it in place.

The hinges 31 and 41 are the type which will limit the angles theta and alpha to about 270 degrees each.

I claim:

1. An apparatus for supporting a seat to a base member, comprising:

a base plate having first and second opposite ends, an upper side and a lower side, means for allowing said lower side of said base plate to be coupled to a base member, a seat plate having first and second opposite ends, an upper side and a lower side, means for allowing a seat to be coupled to said upper side of said seat plate, a support member having first and second opposite ends, an outer side and an inner side, a first hinge connected to said second end of said base plate and to said first end of said seat plate for allowing said seat plate to pivot to a first position generally parallel to said base plate such that said upper side of said seat plate and said lower side of said base plate face in opposite directions and to a second position wherein said seat plate forms an acute angle relative to said base plate, a second hinge connected to said second end of said seat plate and to said first end of said support member for allowing said support member to pivot to a first position generally parallel to said seat plate such that said support member and said seat plate are in a side-by-side relationship with said upper side of said seat plate and said outer side of said support member facing in opposite directions and to a second position wherein said support member forms an angle relative to said seat plate sufficient for support purposes, said first end of said base plate having base plate coupling means and said second end of said support member having support member coupling means, in said first positions of said support member and said seat plate, said support member is located between said seat plate and said base plate, in said second positions of said seat plate and said support member, said support member extends toward said first end of said base plate such that said support member coupling means may be coupled to said base plate coupling means for allowing said support member to support said seat plate in said second position.

2. The apparatus of claim 1, comprising:

a seat connected to said upper side of said seat plate, and a base member connected to said bottom said of said base plate.

3. The apparatus of claim 1, wherein:

said support member coupling means comprises a first tab connected to said second end of said support member, said base plate coupling means comprises at least one aperture formed through said base plate for receiving said first tab when said seat plate and said support member are in said second positions, and a second tab connected to and extending transversely from said outer side of said support member at a position such that said second tab is located in said aperture of said base plate when said seat plate and said support member are located in said first positions.

4. The apparatus of claim 3, comprising:

a seat connected to said upper side of said seat plate, and a base member connected to said bottom said of said base plate.

* * * * *